US008893473B2

(12) United States Patent
Nakata et al.

(10) Patent No.: US 8,893,473 B2
(45) Date of Patent: Nov. 25, 2014

(54) EMISSION CONTROL SYSTEM FOR INTERNAL COMBUSTION ENGINE

(71) Applicant: Denso Corporation, Kariya (JP)

(72) Inventors: Shingo Nakata, Kariya (JP); Mikiyasu Matsuoka, Obu (JP); Hiroki Nogami, Kariya (JP)

(73) Assignee: Denso Corporation, Kariya (JP)

( * ) Notice: Subject to any disclaimer, the term of this patent is extended or adjusted under 35 U.S.C. 154(b) by 124 days.

(21) Appl. No.: 13/768,634

(22) Filed: Feb. 15, 2013

(65) Prior Publication Data

US 2013/0213016 A1 Aug. 22, 2013

(30) Foreign Application Priority Data

Feb. 17, 2012 (JP) ..... 2012-32758

(51) Int. Cl.
*F01N 3/00* (2006.01)
*F02D 41/14* (2006.01)
*F01N 9/00* (2006.01)

(52) U.S. Cl.
CPC ..... *F01N 9/00* (2013.01); *F02D 41/1441* (2013.01); *F02D 41/1476* (2013.01); *F02D 41/1456* (2013.01)
USPC ..... 60/285; 60/276; 60/286

(58) Field of Classification Search
CPC ..... F01N 3/0842; F01N 3/2066; F01N 13/02; F01N 2610/02; F01N 2610/03; F02D 41/0275; F02D 41/0295
USPC ..... 60/276, 285, 286, 299
See application file for complete search history.

(56) References Cited

U.S. PATENT DOCUMENTS

| | | | | |
|---|---|---|---|---|
| 4,741,817 | A | 5/1988 | Croset et al. | |
| 5,499,500 | A * | 3/1996 | Hamburg et al. | 60/274 |
| 6,438,946 | B1 * | 8/2002 | Majima et al. | 60/285 |
| 2002/0038177 | A1 * | 3/2002 | Ishikawa et al. | 701/103 |
| 2002/0038544 | A1 * | 4/2002 | Ikemoto et al. | 60/285 |
| 2003/0196428 | A1 * | 10/2003 | Iida et al. | 60/285 |
| 2013/0206596 | A1 | 8/2013 | Katsurahara et al. | |

FOREIGN PATENT DOCUMENTS

| | | | | |
|---|---|---|---|---|
| DE | 102005044762 | A1 * | 3/2007 | |
| JP | 03258947 | A * | 11/1991 | F02D 41/14 |
| JP | 06288235 | A * | 10/1994 | F01N 3/30 |
| JP | 2-2518247 | | 5/1996 | |

OTHER PUBLICATIONS

Office Action (13 pages) dated Sep. 18, 2014 issued in U.S. Appl. No. 13/761,542, to Katsurahara, filed Feb. 7, 2013.

* cited by examiner

*Primary Examiner* — Thomas Denion
*Assistant Examiner* — Patrick Maines
(74) *Attorney, Agent, or Firm* — Nixon & Vanderhye PC

(57) ABSTRACT

An emission control system for an engine includes an upstream sensor provided upstream of a catalyst in a flow direction of exhaust gas, a downstream sensor provided downstream of the catalyst to detect an air-fuel ratio so that the air-fuel ratio approaches a target air-fuel ratio in a sub feedback control, a constant current supply portion which changes an output characteristic of the downstream sensor by applying a constant current on a pair of electrodes thereof. A characteristic control portion controls the constant current supply portion in the sub feedback control to advance a timing of lean detection of the downstream sensor when the air-fuel ratio is richer than the target air-fuel ratio, and to advance a timing of rich detection of the downstream sensor when the air-fuel ratio is leaner than the target air-fuel ratio.

4 Claims, 13 Drawing Sheets

EMISSION CONTROL SYSTEM FOR INTERNAL COMBUSTION ENGINE

CROSS REFERENCE TO RELATED APPLICATION

This application is based on and incorporates herein by reference Japanese Patent Application No. 2012-032758 filed on Feb. 17, 2012.

TECHNICAL FIELD

The present disclosure relates to an emission control system for an internal combustion engine, which includes a catalyst used for purification of exhaust gas and exhaust-gas sensors arranged respectively upstream and downstream of the catalyst in a flow direction of the exhaust gas.

BACKGROUND

Conventionally, for purpose of improvement of catalytic conversion efficiency of a catalyst used for purification of exhaust gas, an emission control system for an internal combustion engine includes exhaust-gas sensors (e.g., an air/fuel sensor and an oxygen sensor) that are respectively disposed upstream and downstream of the catalyst in a flow direction of the exhaust gas. The exhaust-gas sensors detect an air-fuel ratio of the exhaust gas or detects whether the exhaust gas is rich or lean. The emission control system performs a "main feedback control" and a "sub feedback control". In the main feedback control, the emission control system corrects a fuel injection amount based on an output of the upstream exhaust-gas sensor so that an air-fuel ratio of the exhaust gas flowing upstream of the catalyst becomes equal to an upstream target air-fuel ratio. In the sub feedback control, the emission control system corrects the upstream target air-fuel ratio, a correction amount used in the main feedback control, or the fuel injection amount based on an output of the downstream exhaust-gas sensor so that an air-fuel ratio of the exhaust gas flowing downstream of the catalyst becomes equal to a downstream target air-fuel ratio.

When the air-fuel ratio of the exhaust gas changes from rich to lean or from lean to rich, an output change of the exhaust-gas sensor, such as an oxygen sensor, may lag behind a change of an actual air-fuel ratio of the exhaust gas. Thus, the exhaust-gas sensor may have a room for improvement in its detection responsiveness.

For example, as described in Patent Document 1 (JP 8-20414 B2 corresponding to U.S. Pat. No. 4,741,817 A), at least one of an auxiliary electrochemical cell is incorporated into an inside of a gas sensor for increase in its detection responsiveness.

In order to let the air-fuel ratio of exhaust gas flowing downstream of the catalyst converge smoothly on the downstream target air-fuel ratio in a main feedback control and a sub feedback control, emission control systems are disclosed in Patent Document 2 (JP 2518247 B2) and Patent Document 3 (JP 3826996 B2). In Patent Document 2, an updating amount of a constant used in a feedback control is increased in accordance with increase of a difference between an output of an exhaust-gas sensor located downstream of a catalyst and a predetermined value corresponding to the stoichiometric air-fuel ratio. Additionally, a correction amount of an air-fuel ratio of exhaust gas flowing downstream of the catalyst is calculated depending on an output of an exhaust-gas sensor located upstream of the catalyst and the constant used in the feedback control. In Patent Document 3, a middle target value is set between an air-fuel ratio detected by an exhaust-gas sensor located downstream of a catalyst and a target air-fuel ratio downstream of the catalyst. A correction amount of an upstream target air-fuel ratio is calculated based on the air fuel-ratio detected by the downstream exhaust-gas sensor and the middle target value.

In Patent Document 1, the auxiliary electrochemical cell is necessarily incorporated into the inside of the gas sensor. Thus, when the auxiliary electrochemical cell is incorporated into a general gas sensor that does not have an auxiliary electrochemical cell, the general gas sensor may need to be changed greatly in structure. For practical use, the gas sensor may be required to be changed in design, and a manufacturing cost of the gas sensor may be increased.

In the emission control systems described in Patent Documents 2 and 3, correction of the air-fuel ratio of exhaust gas flowing downstream of the catalyst in the sub feedback control is not switched until the downstream exhaust-gas sensor detects that a conversion efficiency of the catalyst with respect to NOx or HC becomes low (i.e., emission rate of NOx or HC becomes high). Thus, it may be difficult to keep a conversion efficiency of the catalyst high (within a purification window). Therefore, an emission rate of a harmful material such as NOx and HC may increase.

SUMMARY

It is an objective of the present disclosure to provide an emission control system for an internal combustion engine, which is capable of changing an output characteristic of an exhaust-gas sensor without great change in design and cost increase, and capable of lengthening a period within which a conversion efficiency of a catalyst is high while reducing an emission rate of a harmful material such as NOx and HC.

According to an aspect of the present disclosure, an emission control system for an internal combustion engine includes a catalyst, an upstream exhaust-gas sensor, a main feedback control portion, a downstream exhaust-gas sensor, a sub feedback control portion, a constant current supply portion and a characteristic control portion. The catalyst is used for purification of exhaust gas discharged from the engine. The upstream exhaust-gas sensor is provided upstream of the catalyst in a flow direction of the exhaust gas to detect an upstream air-fuel ratio of the exhaust gas flowing upstream of the catalyst or to detect whether the exhaust gas is rich or lean. The main feedback control portion corrects a fuel injection amount of the engine based on an output value of the upstream exhaust-gas sensor in a main feedback control so that the upstream air-fuel ratio becomes equal to an upstream target air-fuel ratio. The downstream exhaust-gas sensor is provided downstream of the catalyst in the flow direction of the exhaust gas to detect a downstream air-fuel ratio of the exhaust gas flowing downstream of the catalyst or to detect whether the exhaust gas is rich or lean. The downstream exhaust-gas sensor includes a sensor element that includes a pair of electrodes and a solid electrolyte body located between the pair of electrodes. The sub feedback control portion corrects the upstream target air-fuel ratio or the fuel injection amount based on an output value of the downstream exhaust-gas sensor in a sub feedback control so that the downstream air-fuel ratio becomes equal to a downstream target air-fuel ratio. The constant current supply portion changes an output characteristic of the downstream exhaust-gas sensor by applying a constant current on the pair of electrodes and setting a flow direction of the constant current between the pair of electrodes. The characteristic control portion controls the constant current supply portion. The characteristic control portion controls the constant current supply portion to apply the constant current on the pair of electrodes so as to advance a timing of a lean detection of the downstream exhaust-gas sensor, when the downstream air-fuel ratio is richer than the downstream target air-fuel ratio, and when the sub feedback control portion corrects the downstream air-fuel ratio such that the downstream air-fuel ratio becomes leaner in the sub feedback control. The characteristic control portion controls the constant current supply portion to apply the constant current on the pair of electrodes so as to advance a timing of a rich detection the downstream exhaust-gas sensor, when the downstream air-fuel ratio is leaner than the downstream target air-fuel ratio, and when the sub feedback control portion corrects the downstream air-fuel ratio such that the downstream air-fuel ratio becomes richer in the sub feedback control.

The constant current supply portion is capable of changing the output characteristic of the downstream exhaust-gas sensor by applying the constant current Ics between the pair of electrodes. There is no need to incorporate an auxiliary electrochemical cell or the like into an inside of the downstream exhaust-gas sensor. Therefore, the output characteristic of the downstream exhaust-gas sensor can be changed without great design changes and cost increase.

When the downstream air-fuel ratio is corrected to be leaner in the sub feedback control, the constant current is applied so that the timing of the lean detection of the downstream exhaust-gas sensor is advanced. Thus, the downstream exhaust-gas sensor can detect promptly that the downstream air-fuel ratio becomes leaner than a purification range (purification window) due to the correction in the sub feedback control. Accordingly, the correction can be switched in the sub feedback control immediately so that the downstream air-fuel ratio is corrected to be richer. Therefore, the downstream air-fuel ratio can be kept or made to return back promptly to within the purification range. As a result, the decrease of a conversion efficiency of the catalyst with respect to NOx can be limited.

On the other hand, when the downstream air-fuel ratio is corrected to be richer in the sub feedback control, the constant current is applied so that the timing of the rich detection of the downstream exhaust-gas sensor is advanced. Thus, the downstream exhaust-gas sensor can detect promptly that the downstream air-fuel ratio becomes richer than the purification range due to the correction in the sub feedback control. Accordingly, the correction can be switched in the sub feedback control immediately so that the downstream air-fuel ratio is corrected to be leaner. Therefore, the downstream air-fuel ratio can be kept or made to return back promptly to within the purification range. As a result, the decrease of a conversion efficiency of the catalyst with respect to HC can be limited.

By performing the above-described process repeatedly, the correction of the sub feedback control can be switched before the conversion efficiency of the upstream catalyst 18 decreases, or at a time when the conversion efficiency of the upstream catalyst 18 starts to decrease. Consequently, a period within which the conversion efficiency of the upstream catalyst 18 is high (i.e., a period within which the air-fuel ratio of the exhaust gas flowing in the upstream catalyst 18 is within the purification range) can be lengthened. Therefore, the emission rates with respect to the harmful material such as NOx and HC can be reduced.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
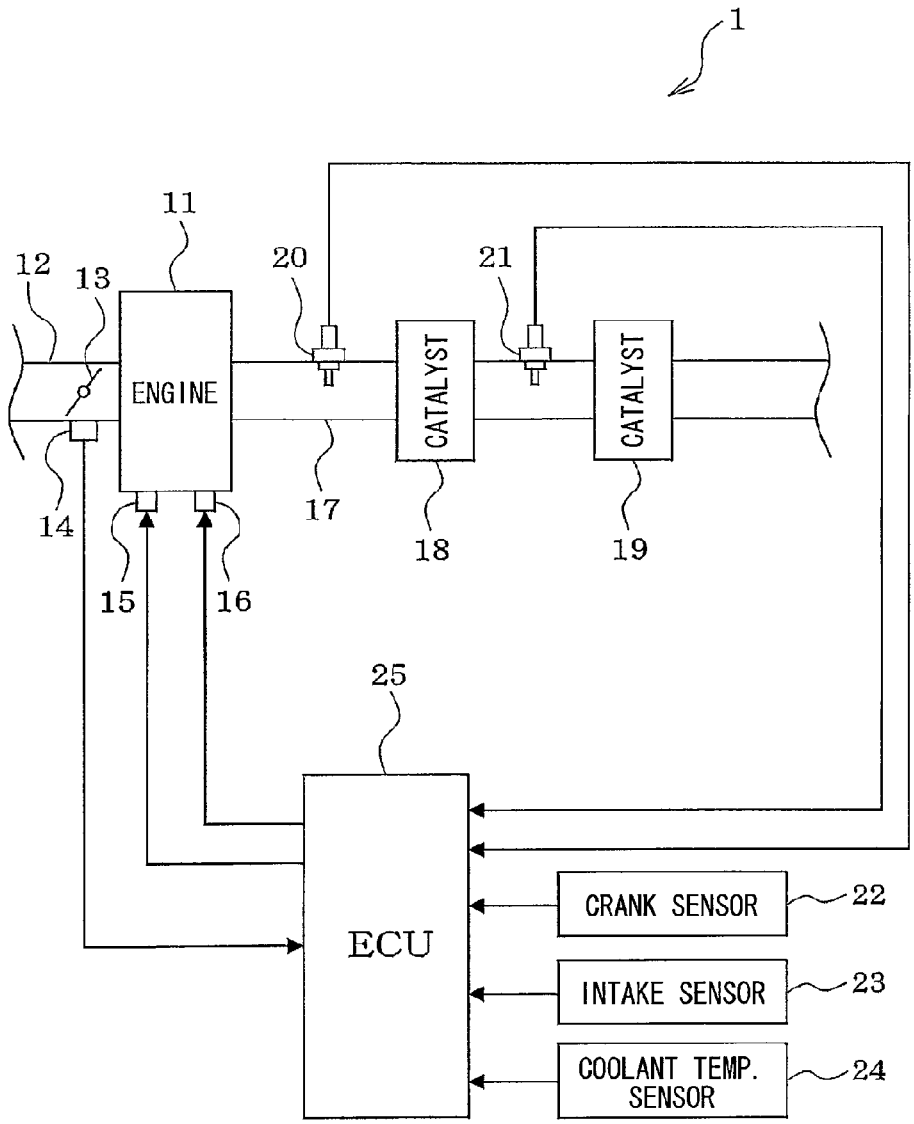
FIG. 1 is a schematic diagram showing an emission control system according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A first embodiment of the present disclosure will be described with reference to FIGS. 1 to 11. First, an emission control system 1 of the present embodiment will be described based on FIG. 1. The emission control system 1 includes an engine 11 (internal combustion engine), an intake pipe 12 through which intake air flows to be drawn into the engine 11, a throttle valve 13 provided in the intake pipe 12, and a throttle sensor 14 provided in the intake pipe 12. An open degree (throttle-open degree) of the throttle valve 13 is adjusted by using a motor or the like, and the throttle sensor 14 detects the throttle-open degree of the throttle valve 13. The engine 11 includes fuel injection valves 15 attached respectively to cylinders of the engine 11 to inject fuel into the cylinders or into intake ports of the cylinders, and spark plugs 16 provided in a cylinder head of the engine 11 adjacent to the cylinders respectively. The spark plugs 16 generate electric spark to ignite air/fuel mixture in the cylinders.

The emission control system 1 further includes an exhaust pipe 17 through which exhaust gas discharged from the engine 11 passes, an upstream catalyst 18 (purification catalyst) provided in the exhaust pipe 17, a downstream catalyst 19 arranged downstream of the upstream catalyst 18 in a flow direction of the exhaust gas in the exhaust pipe 17, an A/F sensor 20 (linear A/F sensor) arranged upstream of the upstream catalyst 18 in the exhaust-gas flow direction in the exhaust pipe 17, and an oxygen sensor 21 ($O_2$ sensor, downstream exhaust-gas sensor) arranged downstream of the upstream catalyst 18, i.e., between the upstream catalyst 18 and the downstream catalyst 19 in the exhaust-gas flow direction in the exhaust pipe 17. The upstream catalyst 18 and the downstream catalyst 19 are, for example, three-way catalysts that purify substances (harmful material), such as carbon monoxide (CO), hydrocarbon (HC) and nitrogen oxide (NOx), contained in the exhaust gas. The A/F sensor 20 outputs a linear signal dependent on an air-fuel ratio of the exhaust gas. The oxygen sensor 21 outputs a voltage (signal value) that changes depending on whether the air-fuel ratio of the exhaust gas is higher or lower than the stoichiometric air-fuel ratio, in other words, whether the air-fuel ratio is lean or rich. When the air-fuel ratio is higher than the stoichiometric air-fuel ratio, it can be said that the air-fuel ratio is lean. When the air-fuel ratio is lower than the stoichiometric air-fuel ratio, it can be said that the air-fuel ratio is rich. The A/F sensor 20 may be used as an example of an upstream exhaust-gas sensor provided upstream of the upstream catalyst 18, and the oxygen sensor 21 may be used as an example of a downstream exhaust-gas sensor provided downstream of the upstream catalyst 18.

Additionally, the emission control system 1 includes various sensors that includes a crank sensor 22 that outputs a pulse signal at each predetermined rotation angle (i.e., crank angle) of a crankshaft of the engine 11, an intake sensor 23 that detects an intake air amount drawn into the engine 11, and a coolant temperature sensor 24 that detects a temperature of coolant for the engine 11. The rotation angle of the crankshaft and a rotation speed of the engine 11 are determined based on the signal outputted from the crank sensor 22.

Outputs of the above-described various sensors are input to an electronic control unit (ECU) 25. The ECU 25 includes a microcomputer 26 shown in FIG. 2, and executes a variety of engine control programs stored in a read-only memory (ROM) embedded in the microcomputer, so that the ECU 25 controls, for example, a fuel-injection amount, an ignition timing and the throttle degree (intake air amount) based on an operational state of the engine 11.

When a predetermined feedback condition is satisfied, the ECU 25 performs a main feedback control and a sub feedback control (sub F-B control). In the main feedback control, an air-fuel ratio (fuel injection amount) of the exhaust gas flowing upstream of the upstream catalyst 18 is corrected based on an output of the A/F sensor 20 (upstream exhaust-gas sensor) so that the air-fuel ratio of the exhaust gas flowing upstream of the upstream catalyst 18 becomes equal to an upstream target air-fuel ratio. In the sub feedback control, the ECU 25 corrects the upstream target air-fuel ratio used in the main feedback control based on an output from the oxygen sensor 21 (downstream exhaust-gas sensor) so that an air-fuel ratio of exhaust gas flowing downstream of the upstream catalyst 18 becomes equal to a downstream target air-fuel ratio, or the ECU 25 corrects a correction amount of the main feedback control or the fuel injection amount. A portion of the ECU 25 which performs the main feedback control may be used as an example of a main feedback control portion that performs the main feedback control. A portion of the ECU 25 which performs the sub feedback control may be used as an example of a sub feedback control portion that performs the sub feedback control.

Next, the oxygen sensor 21 will be described based on FIG. 2. The oxygen sensor 21 includes a sensor element 31 having a cup-like shape. The sensor element 31 is accommodated in a housing or an element case, and is arranged in the exhaust pipe 17 connected to the engine 11.

Figure 2:
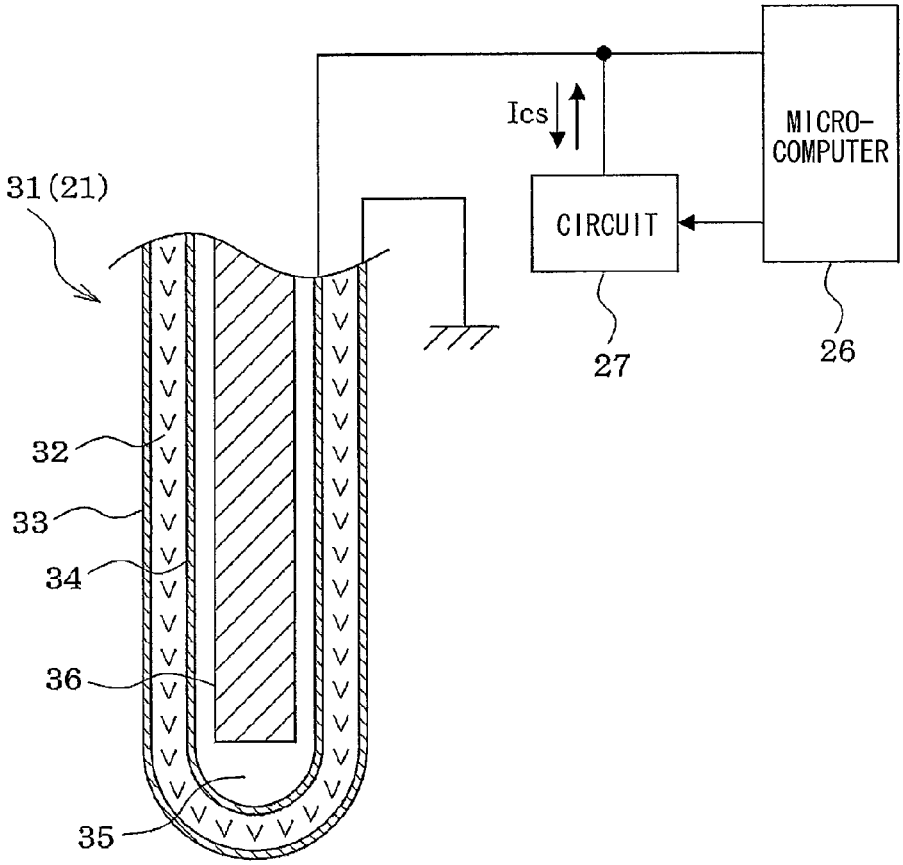
FIG. 2 is a schematic diagram showing a sectional view of a sensor element, a constant current circuit and a microcomputer of the emission control system according to the first embodiment.

The sensor element 31 has a cup-like shape in sectional surface as shown in FIG. 2. The sensor element 31 includes a solid electrolyte layer 32 (solid electrolyte body), an exhaust electrode layer 33 provided on an outer periphery of the solid electrolyte layer 32, and an atmosphere electrode layer 34 provided on an inner periphery of the solid electrolyte layer 32. The solid electrolyte layer 32 is made, for example, of an oxide sintered body having an oxygen-ion conductivity. The oxide sintered body is a solid solution in which a solute, such as CaO, MgO, $Y_2O_3$ or $Yb_2O_3$, is dissolved as a stabilizing agent in a solvent, such as $ZrO_2$, $HfO_2$, $ThO_2$ or $Bi_2O_3$. The electrode layers 33 and 34 are made of noble metal superior in catalytic activity, such as platinum, and are covered with a porous material via chemical plating treatment. These electrode layers 33 and 34 are used as an example of a pair of electrodes (sensor electrodes) which are opposed to each other. The sensor element 31 further includes an atmosphere space 35 surrounded by the atmosphere electrode layer 34, and a heater 36 accommodated in the atmosphere space 35. The heater 36 has a heating capacity enough to activate the sensor element 31, and the sensor element 31 is thereby heated as a whole by heat energy generated by the heater 36. An activation temperature of the oxygen sensor 21 is, for example, approximately from 350° C. to 400° C. The atmosphere space 35 introduces air therein from atmosphere so that an oxygen concentration in the atmosphere space 35 is kept at a predetermined degree.

The exhaust gas flows on outer side of the solid electrolyte layer 32 of the sensor element 31, in other words, the exhaust electrode layer 33 is exposed to the exhaust gas. The air introduced from atmosphere into the sensor element 31 is trapped on an inner side of the solid electrolyte layer 32, in other words, the atmosphere electrode layer 34 is exposed to the introduced air. Hence, an electromotive force is generated between the electrode layers 33 and 34 depending on a difference of an oxygen concentration (oxygen partial pressure) between in the exhaust gas and in the introduced air. Hence, the sensor element 31 generates an electromotive force that changes depending on whether the air-fuel ratio of the exhaust gas is rich or lean. Accordingly, the oxygen sensor 21 outputs a signal of the electromotive force dependent on the oxygen concentration (i.e., air-fuel ratio) of the exhaust gas.

Figure 3:
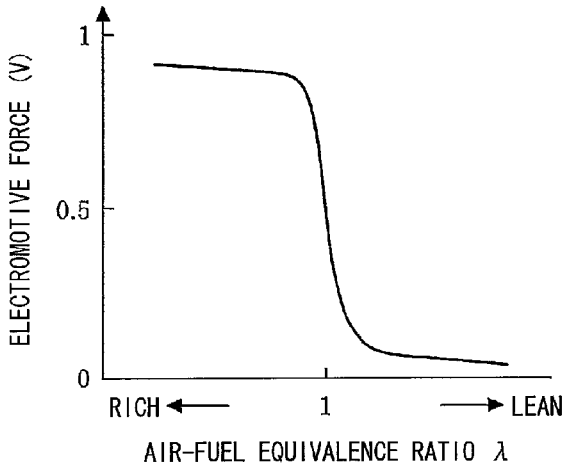
FIG. 3 is a diagram showing a relationship between an air-fuel ratio (air-fuel equivalence ratio λ) of exhaust gas and an electromotive force generated by the sensor element according to the first embodiment.

As shown in FIG. 3, the sensor element 31 generates an electromotive force (voltage) that changes depending whether the air-fuel ratio of the exhaust gas is larger or smaller than the stoichiometric air-fuel ratio, i.e., whether the air-fuel ratio of the exhaust gas is lean or rich. In FIG. 3, when the air-fuel ratio of the exhaust gas is equal to the stoichiometric air-fuel ratio, an air-fuel equivalence ratio $\lambda$ is equal to 1. The sensor element 31 has a characteristic such that the electromotive force generated by the sensor element 31 changes dramatically near the stoichiometric air-fuel ratio at which the air-fuel equivalence ratio $\lambda$ is equal to 1. The sensor element 31 generates a rich electromotive force when the air-fuel ratio is rich, and the sensor element 31 generates a lean electromotive force different from the rich electromotive force in voltage value when the air-fuel ratio is lean. For example, the rich electromotive force is approximately 0.9 V, and the lean electromotive force is approximately 0 V. Alternatively, the rich electromotive force may be set lower than the lean electromotive force.

As shown in FIG. 2, the exhaust electrode layer 33 of the sensor element 31 is grounded, and the atmosphere electrode layer 34 is connected to the microcomputer 26. When the sensor element 31 generates an electromotive force depending on the air-fuel ratio (i.e., oxygen concentration) of the exhaust gas, a detection signal corresponding to the generated electromotive force is output to the microcomputer 26. The microcomputer 26 is, for example, provided in the ECU 25, and calculates the air-fuel ratio of the exhaust gas based on the detection signal. The microcomputer 26 may calculate a rotational speed of the engine 11 or an intake air amount based on detection results of the above-described various sensors.

When the engine 11 is operating, an actual air-fuel ratio of the exhaust gas may alternate between rich and lean repeatedly. In such case, if the oxygen sensor 21 is low in its detection responsiveness, performance of the engine 11 may be affected. For example, in a high-load operation of the engine 11, an amount of NOx in the exhaust gas may become larger than expected.

Figure 4A:
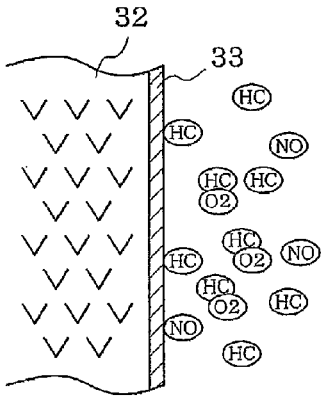
FIG. 4A is a schematic diagram showing a state of components of the exhaust gas around the sensor element when an actual air-fuel ratio changes from rich to lean, according to the first embodiment.
Figure 4B:
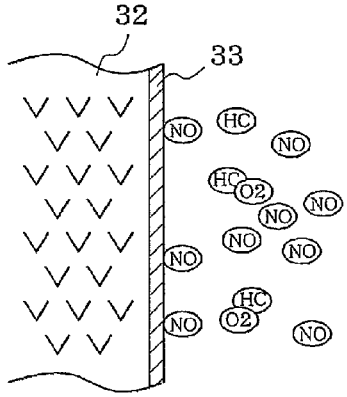
FIG. 4B is a schematic diagram showing a state of the components of the exhaust gas around the sensor element when the actual air-fuel ratio changes from lean to rich, according to the first embodiment.

The detection responsiveness of the oxygen sensor 21 in a case where the actual air-fuel ratio of the exhaust gas changes from rich to lean or from lean to rich will be described. When the actual air-fuel ratio of the exhaust gas discharged from the engine 11 (i.e., the actual air-fuel ratio of the exhaust gas flowing downstream of the upstream catalyst 18) changes from rich to lean or from lean to rich, component composition of the exhaust gas changes. Components of exhaust gas, which flows around the oxygen sensor 21 immediately before the change of the actual air-fuel ratio, may remain around the oxygen sensor 21 immediately after the change of the actual air-fuel ratio. Here, the output of the oxygen sensor 21 changes in accordance with the change of the actual air-fuel ratio. Therefore, the remained components around the oxygen sensor 21 may cause the output change of the oxygen sensor 21 to retard. In other words, the detection responsiveness of the oxygen sensor 21 may decrease. Specifically, immediately after the actual air-fuel ratio changes from rich to lean as shown in FIG. 4A, a rich component such as HC remains around the exhaust electrode layer 33, and disturbs a reaction of a lean component such as NOx. As a result, detection responsiveness of the oxygen sensor 21 may decrease when the actual air-fuel ratio changes from rich to lean. Immediately after the actual air-fuel ratio changes from lean to rich as shown in FIG. 4B, the lean component such as NOx remains around the exhaust electrode layer 33, and disturbs a reaction of the rich component such as HC. As a result, the detection responsiveness of the oxygen sensor 21 may decrease also when the actual air-fuel ratio from lean to rich.

Figure 5:
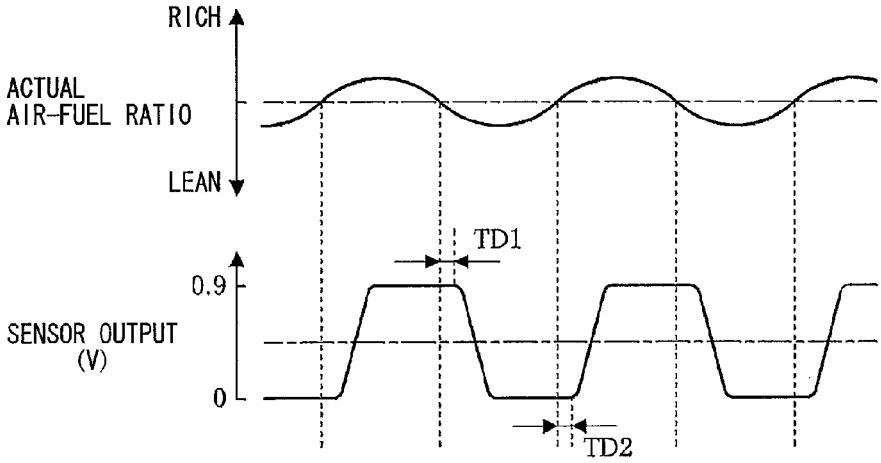
FIG. 5 is a time chart showing behavior of a sensor output in accordance with change of the actual air-fuel ratio in a case where a constant current is not applied to the sensor element, according to the first embodiment.

The output change of the oxygen sensor 21 in a case where a constant current Ics described later is not applied to the sensor element 31 will be described referring to FIG. 5. When the actual air-fuel ratio alternates between rich and lean, an output (sensor output) of the oxygen sensor 21 alternates between the rich electromotive force (e.g., 0.9 V) and the lean electromotive force (e.g., 0 V) in accordance with the alternation of the actual air-fuel ratio. In this case, the change of the sensor output lags behind the change of the actual air-fuel ratio. As shown in FIG. 5, when the actual air-fuel ratio changes from rich to lean, the sensor output of the oxygen sensor 21 changes behind the change of the actual air-fuel ratio by a time TD1. When the actual air-fuel ratio changes from lean to rich, the sensor output of the oxygen sensor 21 changes behind the change of the actual air-fuel ratio by a time TD2.

In the present embodiment, as shown in FIG. 2, a constant current circuit 27 is connected to the atmosphere electrode layer 34. The constant current circuit 27 may be used as an example of a constant current supply portion that applies a constant current on the electrode layers 33 and 34 and sets a flow direction of the constant current between the electrode layers 33 and 34. The microcomputer 26 controls the constant current circuit 27 to supply a constant current Ics to the exhaust electrode layer 33 and the atmosphere electrode layer 34, so that the constant current Ics flows in a predetermined direction between the electrode layers 33, 34. Accordingly, the constant current circuit 27 changes an output characteristic of the oxygen sensor 21 such that the detection responsiveness of the oxygen sensor 21 changes. The microcomputer 26 determines a flow direction and a flow rate of the constant current Ics that is to flow between the electrode layers 33, 34, and the microcomputer 26 controls the constant current circuit 27 so that the constant current Ics flows in the determined flow direction and at the determined flow rate.

The constant current circuit 27 supplies the constant current Ics in positive value or negative value to the atmosphere electrode layer 34, and is capable of adjusting the constant current Ics variably. In other words, the microcomputer 26 controls the constant current Ics variably by a pulse width modulation control (PMW control). In the constant current circuit 27, the constant current Ics is adjusted depending on a duty-cycle signal output from the microcomputer 26, and the adjusted constant current Ics is supplied to the exhaust electrode layer 33 and the atmosphere electrode layer 34.

In the present embodiment, the constant current Ics flowing from the exhaust electrode layer 33 to the atmosphere electrode layer 34 is defined as a negative constant current (−Ics), and the constant current Ics flowing from the atmosphere electrode layer 34 to the exhaust electrode layer 33 is defined as a positive constant current (+Ics).

Figure 6A:
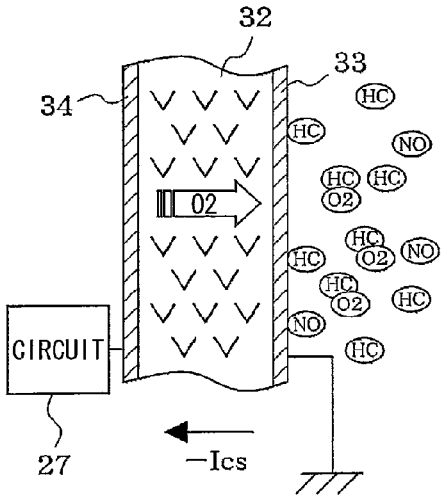
FIG. 6A is a schematic diagram showing a state of the components of the exhaust gas around the sensor element when the actual air-fuel ratio changes from rich to lean, and showing a current direction in the sensor element when a lean responsiveness of the sensor element is increased, according to the first embodiment.

When the detection responsiveness of the oxygen sensor 21 is increased in a case where the actual air-fuel ratio changes from rich to lean, in other words, when a lean sensitivity of the oxygen sensor 21 is increased, the constant current circuit 27 outputs the negative constant current (−Ics) so that oxygen is supplied from the atmosphere electrode layer 34 to the exhaust electrode layer 33 through the solid electrolyte layer 32 as shown in FIG. 6A. The supply of oxygen from the atmosphere electrode layer 34 to the exhaust electrode layer 33 promotes oxidation reaction of the rich component (e.g., HC) that exists (remains) around the exhaust electrode layer 33. Hence, the rich component can be removed from around the exhaust electrode layer 33 promptly. Accordingly, the lean component (e.g., NOx) becomes easy to react at the exhaust electrode layer 33, and the detection responsiveness of the oxygen sensor 21 can be increased when the actual air-fuel ratio changes to rich to lean. In other words, a lean responsiveness (lean sensitivity) of the oxygen sensor 21 is increased. Here, the lean responsiveness of the oxygen sensor 21 is the detection responsiveness of the oxygen sensor 21 with respect to lean gas that is exhaust gas having an actual air-fuel ratio leaner (i.e., higher) than the stoichiometric air-fuel ratio.

Figure 6B:
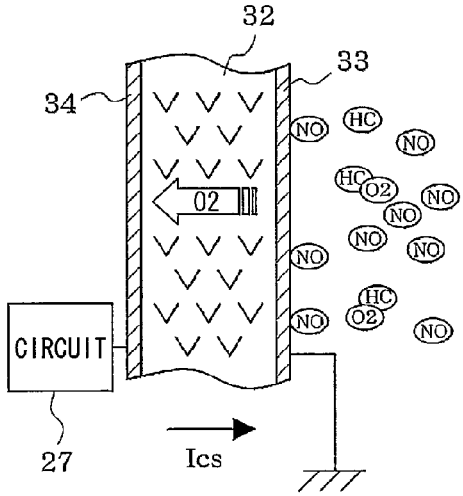
FIG. 6B is a schematic diagram showing a state of the components of the exhaust gas around the sensor element when the actual air-fuel ratio changes from lean to rich, and showing a current direction in the sensor element when a rich responsiveness of the sensor element is increased, according to the first embodiment.

When the detection responsiveness of the oxygen sensor 21 is increased in a case where the actual air-fuel ratio changes from lean to rich, in other words, when a rich sensitivity of the oxygen sensor 21 is increased, the constant current circuit 27 outputs the positive constant current (+Ics) so that oxygen is supplied from the exhaust electrode layer 33 to the atmosphere electrode layer 34 through the solid electrolyte layer 32 as shown in FIG. 6B. The supply of oxygen from the exhaust electrode layer 33 to the atmosphere electrode layer 34 promotes reduction reaction of the lean component (e.g., NOx) that exists (remains) around the exhaust electrode layer 33. Hence, the lean component can be removed from around the exhaust electrode layer 33 promptly. Accordingly, the rich component (e.g., HC) becomes easy to react at the exhaust electrode layer 33, and the detection responsiveness of the oxygen sensor 21 can be increased when the actual air-fuel ratio changes to lean to rich. In other words, a rich responsiveness (rich sensitivity) of the oxygen sensor 21 is increased. Here, the rich responsiveness of the oxygen sensor 21 is the detection responsiveness of the oxygen sensor 21 with respect to rich gas that is exhaust gas having an actual air-fuel ratio richer (i.e., lower) than the stoichiometric air-fuel ratio.

Figure 7:
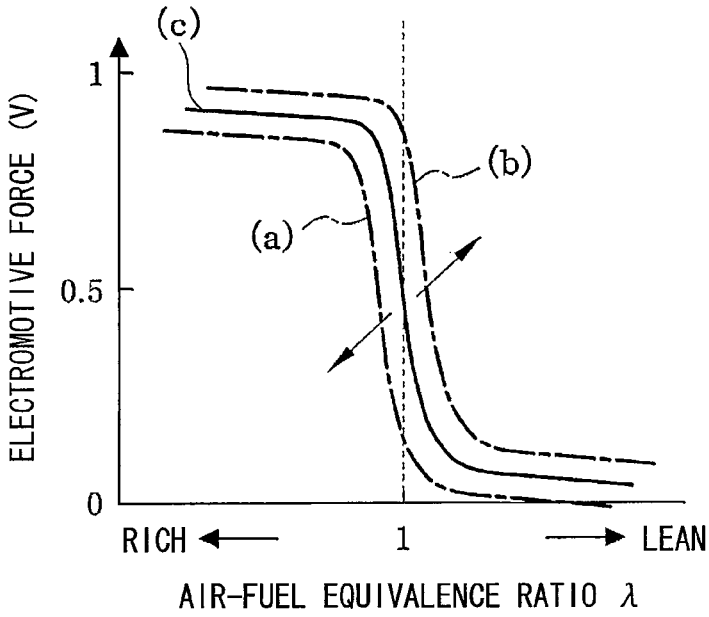
FIG. 7 is a diagram showing a relationship between the air-fuel ratio (air-fuel equivalence ratio λ) of the exhaust gas and the electromotive force generated by the sensor element according to the first embodiment.

FIG. 7 shows the output characteristic (electromotive force characteristic) of the oxygen sensor 21. The curve (a) shown in FIG. 7 is an output characteristic line of the oxygen sensor 21 when the lean responsiveness (lean sensitivity) is increased in a case where the actual air-fuel ratio changes from rich to lean. The curve (b) shown in FIG. 7 is an output characteristic line of the oxygen sensor 21 when the rich responsiveness (rich sensitivity) is increased in a case where the actual air-fuel ratio changes from lean to rich. The curve (c) shown in FIG. 7 is an output characteristic line same as that shown in FIG. 3, in other words, the curve (c) is when the constant current Ics is not applied to the electrode layers 33 and 34.

As described above, when the lean responsiveness (lean sensitivity) is increased in the case where the actual air-fuel ratio changes from rich to lean, the negative constant current (−Ics) flows between the electrode layers 33 and 34 so that oxygen is supplied from the atmosphere electrode layer 34 to the exhaust electrode layer 33 through the solid electrolyte layer 32 as shown in FIG. 6A. In this case, as shown in FIG. 7, the output characteristic line (a) is located on a richer side of the output characteristic line (c) in air-fuel equivalence ratio λ, and is located on a lower side of the output characteristic line (c) in electromotive force. Thus, even when the actual air-fuel ratio (air-fuel equivalence ratio λ) is within a rich region that is an air-fuel ratio region lower than the stoichiometric air-fuel ratio, the oxygen sensor 21 can output the lean electromotive force when the actual air-fuel ratio is near the stoichiometric air-fuel ratio. Therefore, with respect to the output characteristic of the oxygen sensor 21, the detection responsiveness (lean sensitivity) of the oxygen sensor 21 can be increased when the actual air-fuel ratio changes from rich to lean.

When the rich responsiveness (rich sensitivity) is increased in the case where the actual air-fuel ratio changes from lean to rich, the positive constant current (+Ics) flows between the electrode layers 33 and 34 so that oxygen is supplied from the exhaust electrode layer 33 to the atmosphere electrode layer 34 through the solid electrolyte layer 32 as shown in FIG. 6B. In this case, as shown in FIG. 7, the output characteristic line (b) is located on a leaner side of the output characteristic line (c) in air-fuel equivalence ratio λ, and is located on a higher side of the output characteristic line (c) in electromotive force. Thus, even when the actual air-fuel ratio (air-fuel equivalence ratio λ) is within a lean region that is an air-fuel ratio region higher than the stoichiometric air-fuel ratio, the oxygen sensor 21 can output the rich electromotive force when the actual air-fuel ratio is near the stoichiometric air-fuel ratio. Therefore, with respect to the output characteristic of the oxygen sensor 21, the detection responsiveness (rich sensitivity) of the oxygen sensor 21 can be increased when the actual air-fuel ratio changes from lean to rich.

Figure 8:
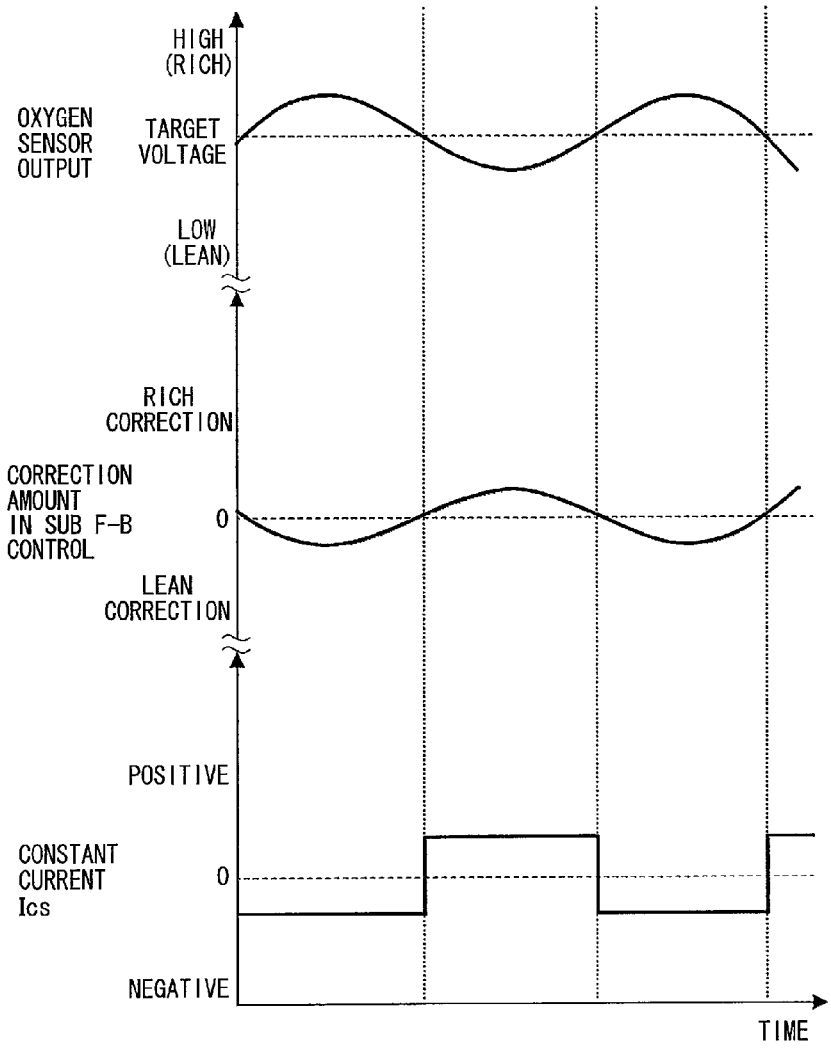
FIG. 8 is a time chart showing changes of an output of an oxygen sensor, a correction amount in a sub feedback control, and a constant current Ics, according to the first embodiment.
Figure 9:
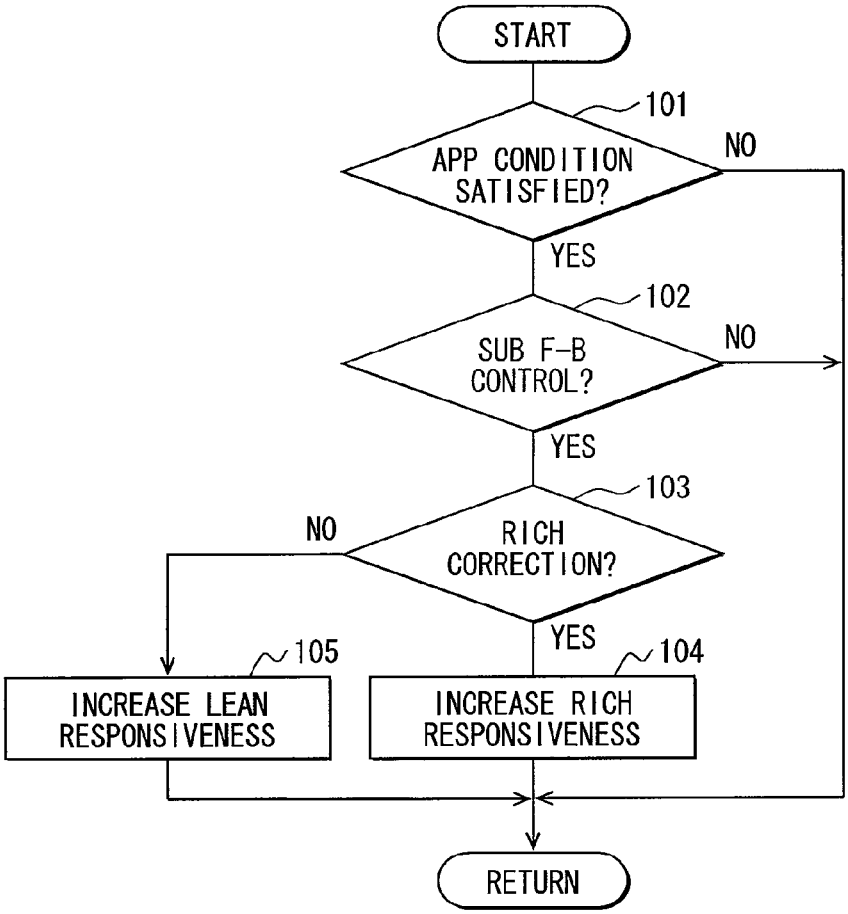
FIG. 9 is a flowchart showing a control process of a characteristic control routine according to the first embodiment.

In the present embodiment, the ECU 25 (or the microcomputer 26) performs a characteristic control routine shown in FIG. 9 to control the constant current circuit 27 as shown in FIG. 8. As shown in FIG. 8, when the output of the oxygen sensor 21 is higher than a target voltage (downstream target value) corresponding to the downstream target air-fuel ratio, in other words, when the air-fuel ratio of the exhaust gas flowing downstream of the upstream catalyst 18 is richer than the downstream target air-fuel ratio, a lean correction is performed in the sub feedback control, in which the air-fuel ratio of the exhaust gas flowing downstream of the upstream catalyst 18 is corrected to be leaner. Additionally, the constant current circuit 27 is controlled to supply a negative constant current −Ics to the electrode layers 33, 34 such that the oxygen sensor 21 can detect the lean gas early, in other words, a timing of a lean detection of the oxygen sensor 21 can be advanced. In other words, the constant current circuit 27 is controlled to supply the negative constant current −Ics such that the lean responsiveness of the oxygen sensor 21 is increased. Accordingly, the oxygen sensor 21 is capable of detecting early that the air-fuel ratio of the exhaust gas flowing in the upstream catalyst 18 becomes leaner than a purification range (purification window) that is a range of the air-fuel ratio within which a conversion efficiency of the upstream catalyst 18 is high. Therefore, the lean correction can be switched promptly to a rich correction in the sub feedback control when the air-fuel ratio of the exhaust gas flowing in the upstream catalyst 18 becomes leaner than the purification range. Here, in the rich correction, the air-fuel ratio of the exhaust gas flowing downstream of the upstream catalyst 18 is corrected to become richer. As a result, the air-fuel ratio of the exhaust gas flowing in the upstream catalyst 18 can be kept or made to return back promptly to within the purification range, and decrease of a conversion efficiency with respect to NOx can be thereby restricted.

On the other hand, when the output of the oxygen sensor 21 is lower than the target voltage as shown in FIG. 8, in other words, when the air-fuel ratio of the exhaust gas flowing downstream of the upstream catalyst 18 is leaner than the downstream target air-fuel ratio, the rich correction is performed in the sub feedback control so that the air-fuel ratio of the exhaust gas flowing downstream of the upstream catalyst 18 becomes richer. Additionally, the constant current circuit 27 is controlled to supply a positive constant current +Ics to the electrode layers 33, 34 such that the oxygen sensor 21 can detect the rich gas early, i.e., a timing of a rich detection of the oxygen sensor 21 can be advanced. In other words, the constant current circuit 27 is controlled to supply the positive constant current +Ics such that the rich responsiveness of the oxygen sensor 21 is increased. Accordingly, the oxygen sensor 21 is capable of detecting early that the air-fuel ratio of the exhaust gas flowing in the upstream catalyst 18 becomes richer than the purification range. Therefore, the rich correction can be switched promptly to the lean correction in the sub feedback control when the air-fuel ratio of the exhaust gas flowing in the upstream catalyst 18 becomes richer than the purification range. As a result, the air-fuel ratio of the exhaust gas flowing in the upstream catalyst 18 can be kept or made to return back promptly to within the purification range, and decrease of a conversion efficiency with respect to HC can be restricted.

The characteristic control routine shown in FIG. 9 will be described. The characteristic control routine is performed with a predetermined period when the ECU 25 is operating. The characteristic control routine may be used as an example of a characteristic control portion which controls the constant current supply portion.

When the characteristic control routine is started, it is determined at step 101 whether a predetermined current application condition (app condition) is satisfied. For example, it is determined whether the oxygen sensor 21 is normal (i.e., whether the oxygen sensor 21 does not have abnormality), or whether the oxygen sensor 21 is in an activation state. When the current application condition is determined not to be satisfied at step 101, the characteristic control routine is terminated without performing any control operation.

When the current application condition is determined to be satisfied at step 101, it is determined at step 102 whether the sub feedback control is performed. When the sub feedback control is determined not to be performed, the characteristic control routine is terminated without performing any control operation.

When the sub feedback control is determined to be performed at step 102, it is determined at step 103 whether the rich correction is performed in the sub feedback control.

When the rich correction is determined at step 103 to be performed in the sub feedback control, a control operation of step 104 is performed. At step 104, the constant current circuit 27 is controlled to apply the constant current Ics so that the constant current Ics flows in a direction in which the timing of the rich detection of the oxygen sensor 21 is advanced (i.e., the constant current circuit 27 is controlled to apply the constant current Ics on the electrode layers 33, 34 so that the rich responsiveness of the oxygen sensor 21 is increased).

When the rich correction of the sub feedback control is determined at step 103 not to be performed (i.e., when the lean correction of the sub feedback control is determined to be performed), a control operation of step 105 is performed. At step 105, the constant current circuit 27 is controlled to apply the constant current Ics so that the constant current Ics flows in a direction in which the timing of the lean detection of the oxygen sensor 21 is advanced (i.e., the constant current circuit 27 is controlled to apply the constant current Ics on the electrode layers 33, 34 so that the lean responsiveness of the oxygen sensor 21 is increased). Portions of the ECU 25 (or the microcomputer 26) which perform control operations of steps 104 and 105 may be used as an example of the characteristic control portion.

In the above-described first embodiment, the constant current circuit 27 provided outside the oxygen sensor 21 applies the constant current Ics between the pair of sensor electrodes 33 and 34. Accordingly, the output characteristic of the oxygen sensor 21 can be changed. Furthermore, there is no need to incorporate an auxiliary electrochemical cell or the like into an inside of the oxygen sensor 21. Therefore, the output characteristic of the oxygen sensor 21 can be changed without great design changes and cost increase.

Figure 10:
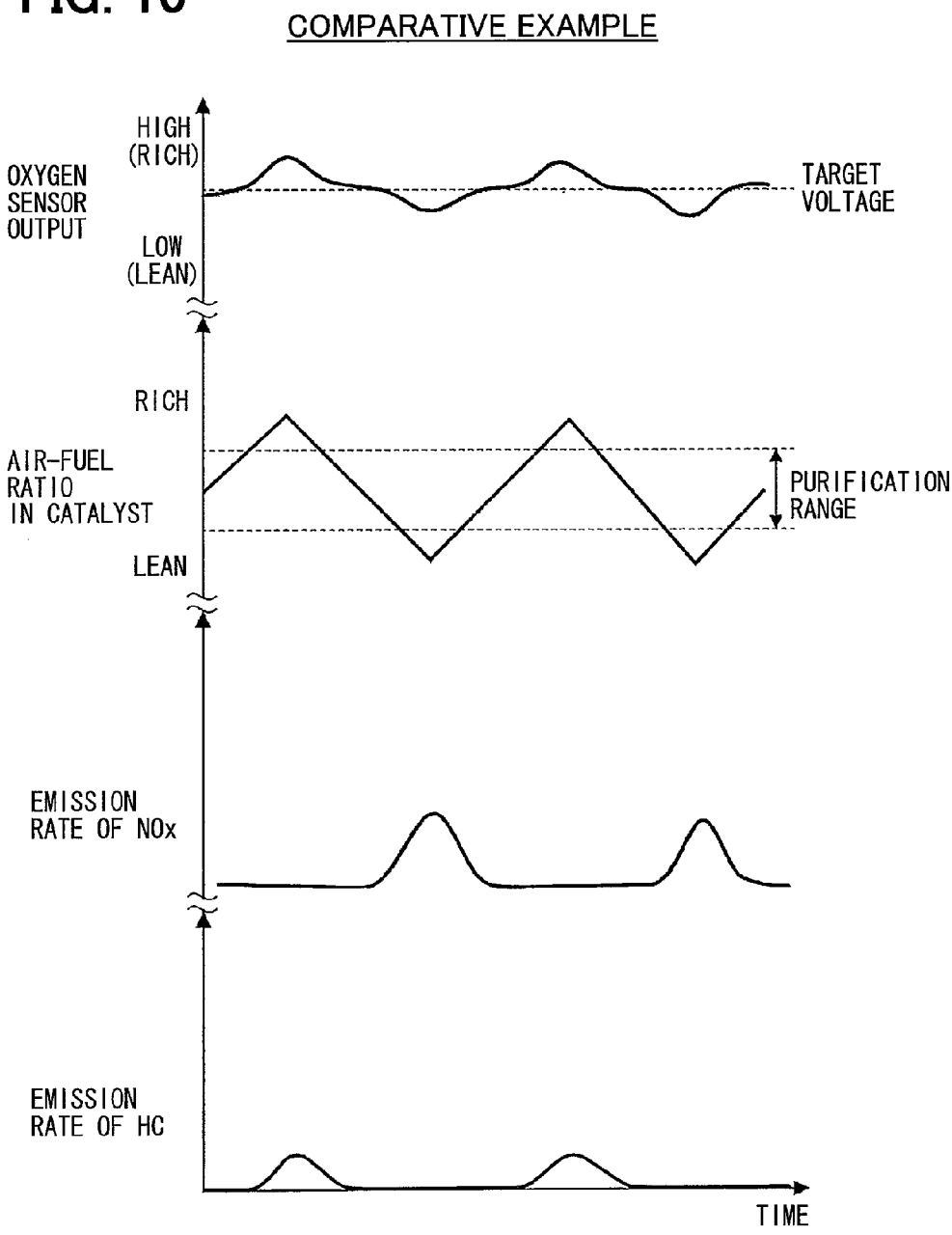
FIG. 10 is a time chart showing changes of an output of an oxygen sensor, an air-fuel ratio in an upstream catalyst, an emission rate of NOx and an emission rate of HC, according to a comparative example.

In a comparative example shown in FIG. 10, an emission control system does not have a function to change an output characteristic of an oxygen sensor provided downstream of a catalyst in a flow direction of exhaust gas. Thus, when an air-fuel ratio of the exhaust gas flowing in the catalyst becomes richer or leaner than a purification range of the catalyst due to the rich correction or the lean correction in the sub feedback control, the oxygen sensor cannot detect promptly that the air-fuel ratio of the exhaust gas flowing in the catalyst becomes richer or leaner than the purification range. Hence, a timing of the switching of the sub feedback control between the rich correction and the lean correction may be delayed, and the air-fuel ratio of the exhaust gas flowing in the catalyst cannot be made to return back to within the purification range promptly. Therefore, the conversion efficiencies with respect to NOx and HC may decrease, and emission rates of NOx and HC may thereby increase.

Figure 11:
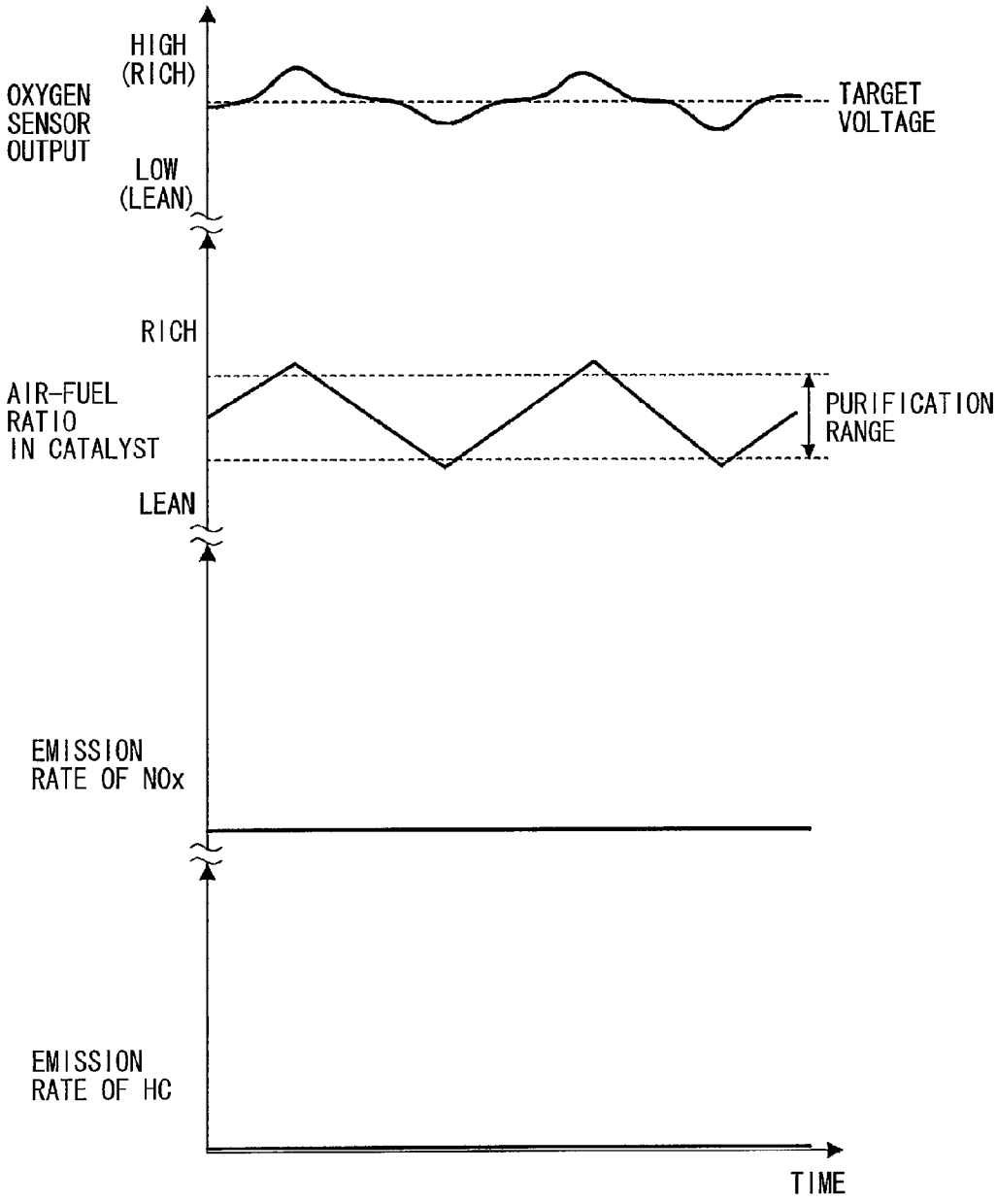
FIG. 11 is a time chart showing changes of the output of the oxygen sensor, an air-fuel ratio in an upstream catalyst, an emission rate of NOx and an emission rate of HC, according to the first embodiment.

In the first embodiment, when the lean correction is performed in the sub feedback control, the constant current Ics is applied so that the timing of the lean detection of the oxygen sensor 21 is advanced (i.e., the constant current Ics is applied so that the lean responsiveness of the oxygen sensor 21 is increased). Thus, when the air-fuel ratio of the exhaust gas flowing in the upstream catalyst 18 becomes leaner than the purification range due to the lean correction, the oxygen sensor 21 can detect promptly that the air-fuel ratio becomes leaner than the purification range. Accordingly, the lean correction can be switched to the rich correction in the sub feedback control immediately. Therefore, as shown in FIG. 11, the air-fuel ratio of the exhaust gas flowing in the upstream catalyst 18 can be kept or made to return back promptly to within the purification range. As a result, the decrease of the conversion efficiency with respect to NOx can be restricted, and the emission rate of NOx can be reduced.

When the rich correction is performed in the sub feedback control, the constant current Ics is applied so that the timing of the rich detection of the oxygen sensor 21 is advanced (i.e., the constant current Ics is applied so that the rich responsiveness of the oxygen sensor 21 is increased). Thus, when the air-fuel ratio of the exhaust gas flowing in the upstream catalyst 18 becomes richer than the purification range due to the rich correction, the oxygen sensor 21 can detect promptly that the air-fuel ratio becomes richer than the purification range. Accordingly, the rich correction can be switched to the lean correction in the sub feedback control immediately. Therefore, as shown in FIG. 11, the air-fuel ratio of the exhaust gas flowing in the upstream catalyst 18 can be kept or made to return back promptly to within the purification range. As a result, the decrease of the conversion efficiency with respect to HC can be restricted, and the emission rate of HC can be reduced.

By performing the above-described control process repeatedly, the rich correction and the lean correction can be switched therebetween in the sub feedback control before the conversion efficiency of the upstream catalyst 18 decreases, or at a time when the conversion efficiency of the upstream catalyst 18 starts to decrease. Consequently, a period within which the conversion efficiency of the upstream catalyst 18 can be kept high (i.e., a period within which the air-fuel ratio of the exhaust gas flowing in the upstream catalyst 18 can be kept within the purification range) can be lengthened. Therefore, the emission rates with respect to the harmful material such as NOx and HC can be reduced.

(Second Embodiment)

A second embodiment will be described referring to FIG. 12. A part substantially same as a part of the first embodiment will be omitted or simplified, and a part different from the first embodiment will be described in the second embodiment.

Figure 12:
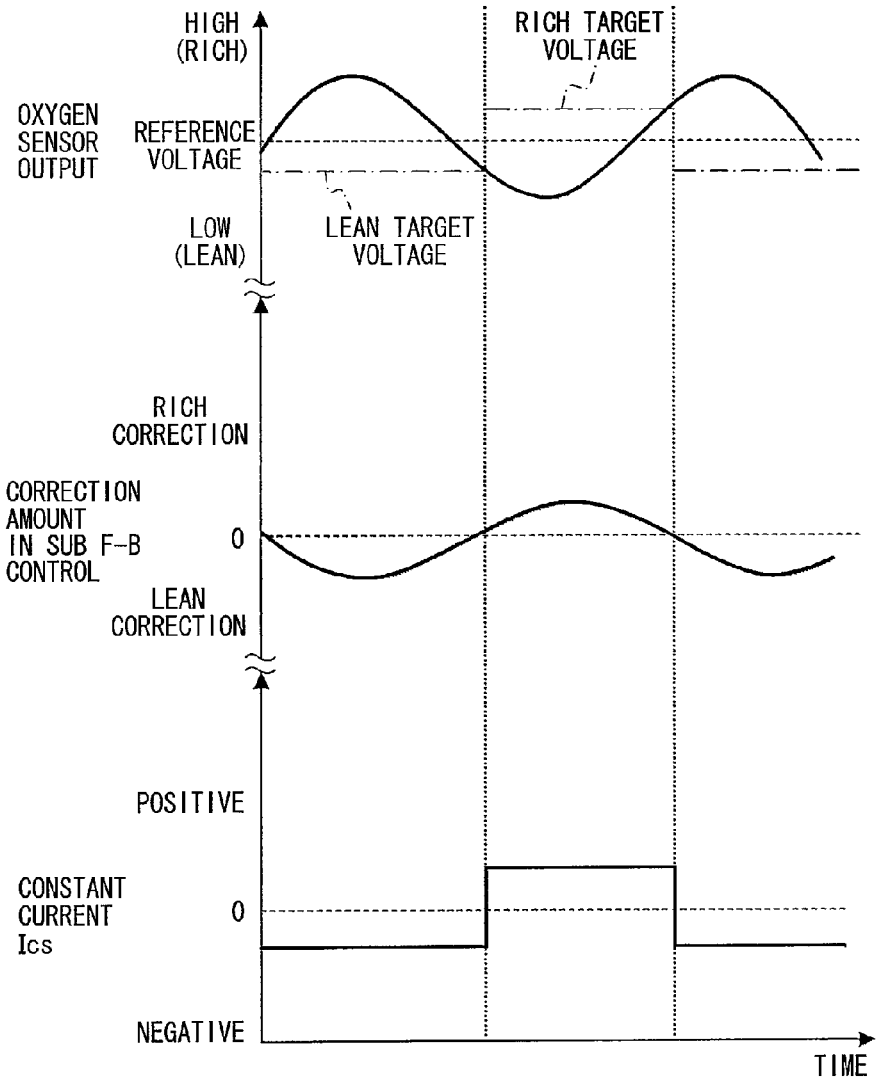
FIG. 12 is a time chart showing changes of an output of an oxygen sensor, a correction amount in a sub feedback control, and a constant current Ics, according to a second embodiment of the present disclosure.

In the second embodiment, as shown in FIG. 12, when a lean correction is performed in a sub feedback control, a target voltage (downstream target value) of am output of an oxygen sensor 21 is set at a lean target voltage that is lower than a reference voltage (reference value). On the other hand, when a rich correction is performed in the sub feedback control, the target voltage of the output of the oxygen sensor 21 is set at a rich target voltage that is higher than the reference voltage. In other words, when the lean correction is performed in the sub feedback control, a downstream target air-fuel ratio is set leaner than a reference air-fuel ratio corresponding to the reference value. When the rich correction is performed in the sub feedback control, the downstream target air-fuel ratio is set richer than the reference air-fuel ratio. The reference voltage may correspond to the stoichiometric air-fuel ratio.

Accordingly, a hysteresis characteristic can be provided in switching between the lean correction and the rich correction in the sub feedback control. Therefore, a flow direction of a constant current Ics between electrode layers 33, 34 can be prevented from switching frequently, and the output of the oxygen sensor 21 can be prevented from fluctuating. In other words, haunting of the output of the oxygen sensor 21 can be prevented.

(Third Embodiment)

A third embodiment of the present disclosure will be described referring to FIG. 13. A part substantially same as a part of the first embodiment will be omitted or simplified, and a part different from the first embodiment will be described in the third embodiment.

Figure 13:
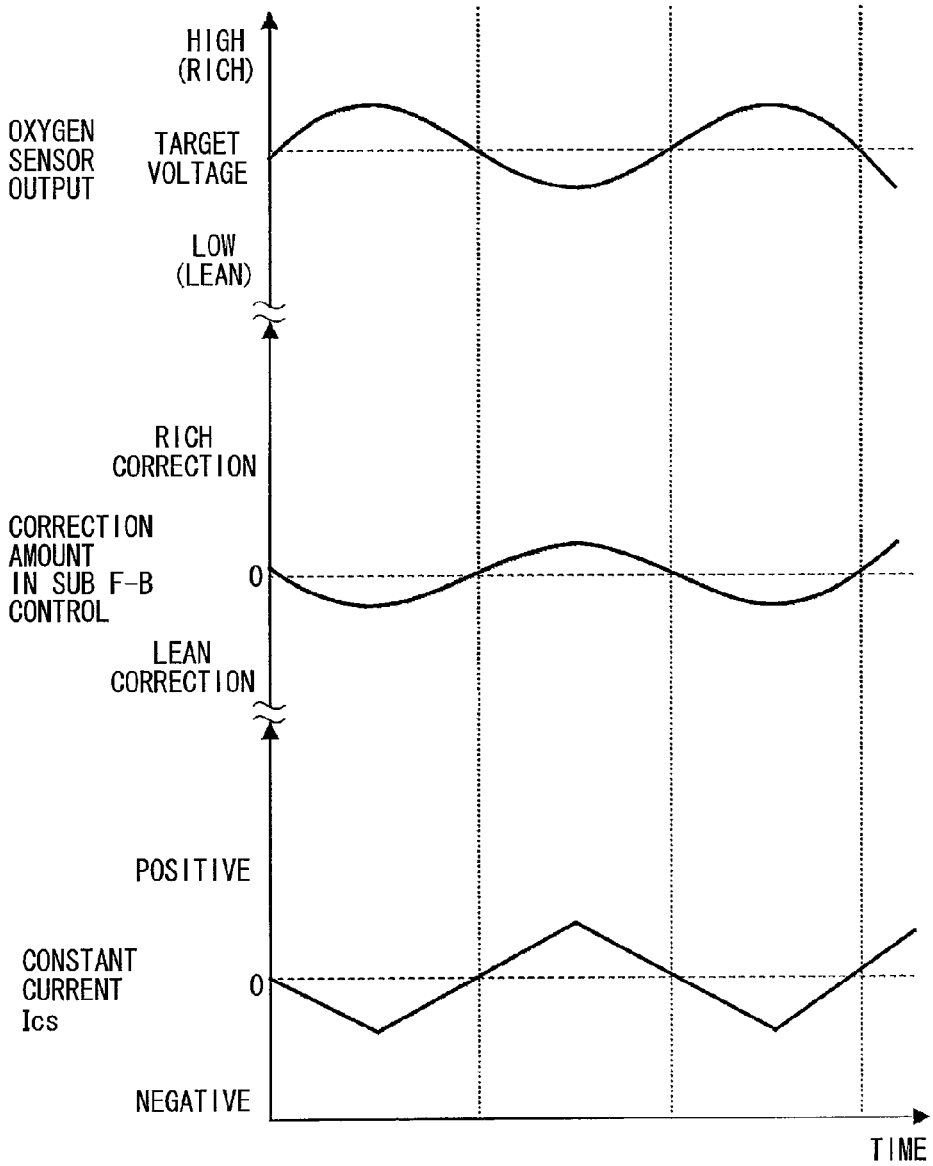
FIG. 13 is a time chart showing changes of an output of an oxygen sensor, a correction amount in a sub feedback control, and a constant current Ics, according to a third embodiment of the present disclosure.

In the third embodiment, as shown in FIG. 13, a value of a constant current Ics is set depending on a difference between an output of an oxygen sensor 21 and a target voltage. For example, the larger the difference (absolute value) between the output of the oxygen sensor 21 and the target voltage, the larger the value (absolute value) of the constant current Ics is set.

When the difference (absolute value) between the output of the oxygen sensor 21 and the target voltage is relatively large, in other words, when a correction amount (absolute value) in a sub feedback control is relatively large, the value (absolute value) of the constant current Ics becomes large so that the detection responsiveness of the oxygen sensor 21 is increased. In other words, a timing of a rich detection or a timing of a lean detection is advanced. Hence, it can be prevented that convergent of the output of the oxygen sensor 21 on the target voltage becomes poor due to an excess correction amount of the sub feedback control. On the other hand, when the difference (absolute value) between the output of the oxygen sensor 21 and the target voltage is relatively small, in other words, when the correction amount (absolute value) in the sub feedback control is relatively small, the value (absolute value) of the constant current Ics becomes small so that the detection responsiveness of the oxygen sensor 21 is decreased. In other words, the timing of the rich detection or the timing of the lean detection is retarded. Accordingly, the output of the oxygen sensor 21 can be converged on the target voltage promptly.

Both the technologies of the second and third embodiments may be combined with the technology of the first embodiment.

(Fourth Embodiment)

Next, a fourth embodiment of the present disclosure will be described in reference to FIGS. 14 and 15. A part substantially same as a part of the first embodiment will be omitted or simplified, and a part different from the first embodiment will be described in the fourth embodiment.

Figure 14:
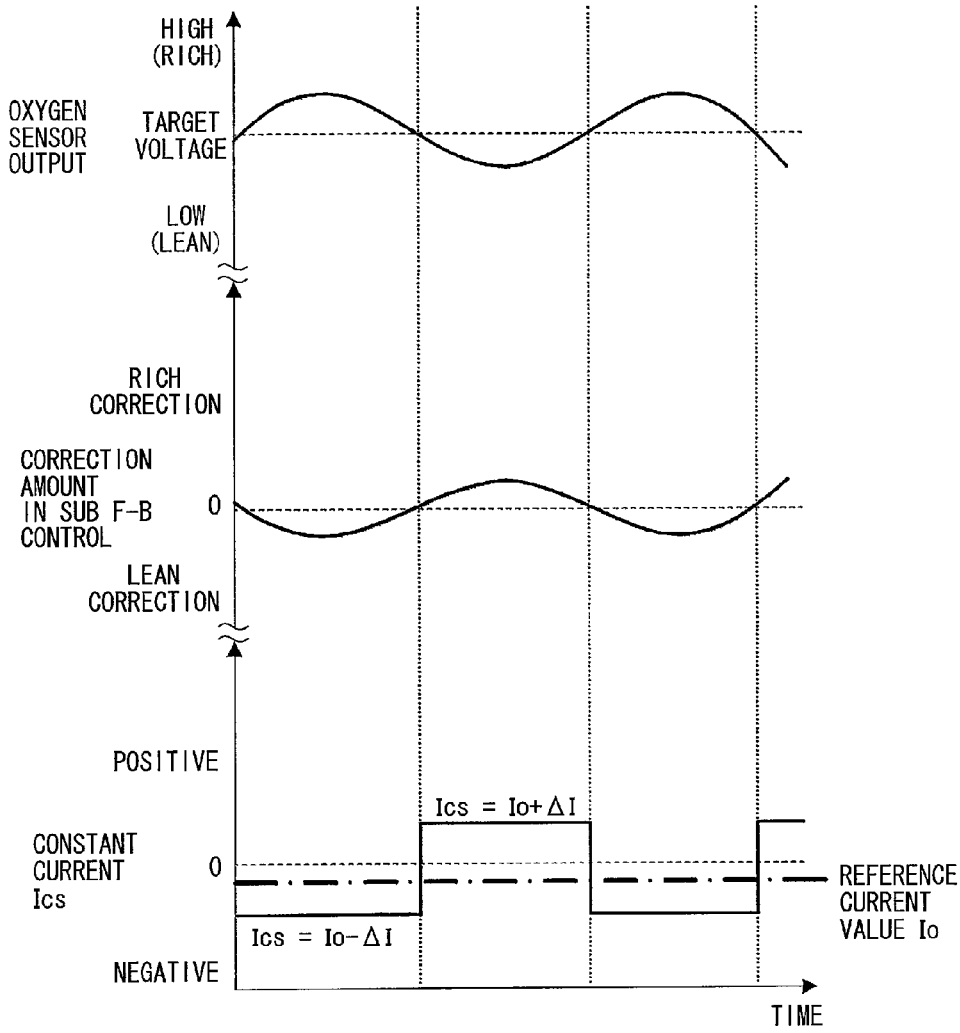
FIG. 14 is a time chart showing changes of an output of an oxygen sensor, a correction amount in a sub feedback control, and a constant current Ics, according to a fourth embodiment of the present disclosure.
Figure 15:
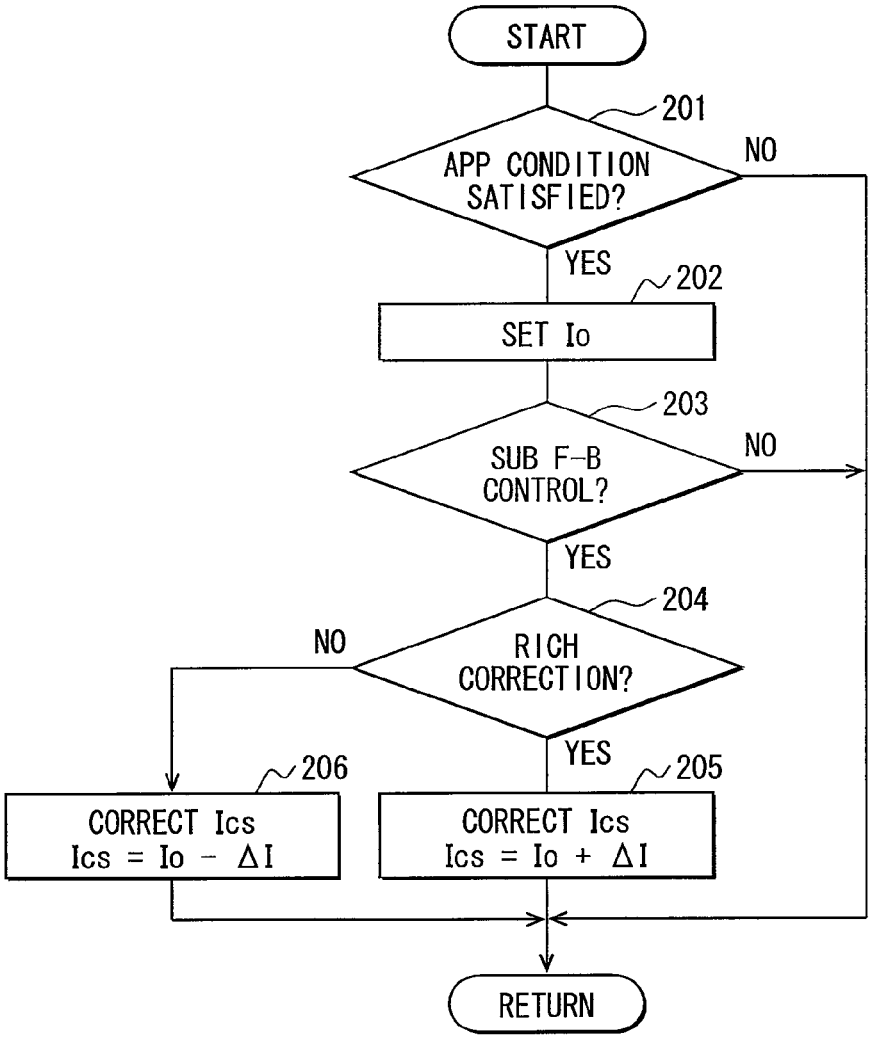
FIG. 15 is a flowchart showing a control process of a characteristic control routine according to the fourth embodiment.

In the fourth embodiment, an ECU 25 (or a microcomputer 26) performs a characteristic control routine shown in FIG. 15 to control a constant current circuit 27 as shown in FIG. 14. A reference current value Io shown by a thick alternate long and short dash line in FIG. 14 is set by using a map or the like depending on an operating condition of the engine (e.g., a rotation rate of the engine or a load applied on the engine). When an output of an oxygen sensor 21 is higher than a target voltage (downstream target voltage), in other words, when an air-fuel ratio of exhaust gas flowing downstream of an upstream catalyst 18 is richer than a downstream target air-fuel ratio corresponding to the downstream target voltage, a lean correction is performed in a sub feedback control so that the air-fuel ratio becomes leaner. Additionally, the constant current circuit 27 is controlled to correct a value of a constant current Ics so that a timing of a lean detection of the oxygen sensor 21 becomes earlier than that in a case where the value of the constant current Ics is equal to the reference current value Io. In other words, the constant current circuit 27 is controlled to correct the value of the constant current Ics so that a lean responsiveness of the oxygen sensor 21 becomes higher than that in the case where the value of the constant current Ics is equal to the reference current value Io. On the other hand, when the output of the oxygen sensor 21 is lower than the target voltage, in other words, when the air-fuel ratio of the exhaust gas flowing downstream of the upstream catalyst 18 is leaner than the downstream target air-fuel ratio, a rich correction is performed in the sub feedback control so that the air-fuel ratio becomes richer. Additionally, the constant current circuit 27 is controlled to correct the value of the constant current Ics so that a timing of a rich detection of the oxygen sensor 21 becomes earlier than that in the case where the value of the constant current Ics is equal to the reference current value Io. In other words, the constant current circuit 27 is controlled to correct the value of the constant current Ics so that a rich responsiveness of the oxygen sensor 21 becomes higher than that in the case where the value of the constant current Ics is equal to the reference current value Io.

The characteristic control routine shown in FIG. 15 will be described. In the characteristic control routine, it is determined firstly at step 201 whether a current application condition (app condition) is satisfied. The current application condition in the fourth embodiment may be same as the current application condition shown in step 101 of FIG. 9. When the current application condition is determined to be satisfied at step 201, a control operation of step 202 is performed. At step 202, the reference current value Io is set (calculated) by using a map or the like depending on a present operating condition of the engine 11 (e.g., engine rotation rate or engine load), and the constant current circuit 27 is controlled to set the value of the constant current Ics at the reference current value Io (Ics=Io).

At next step 203, it is determined whether the sub feedback control is performed. When the sub feedback control is determined to be performed, it is determined at step 204 whether the rich correction is performed in the sub feedback control.

When the rich correction is determined at step 204 to be performed in the sub feedback control, a control operation of step 205 is performed. At step 205, the constant current circuit 27 is controlled to correct the value of the constant current Ics by adding the predetermined value ΔI to the reference current value Io (Ics=Io+ΔI) so that the timing of the rich detection of the oxygen sensor 21 is advanced, i.e., the rich responsiveness of the oxygen sensor 21 is increased.

When the rich correction is determined at step 204 not to be performed in the sub feedback control, in other words, when the lean correction is determined to be performed in the sub feedback control, a control operation of step 206 is performed. At step 206, the constant current circuit 27 is controlled to correct the value of the constant current Ics by subtracting the predetermined value ΔI from the reference current value Io (Ics=Io−ΔI) so that the timing of the lean detection of the oxygen sensor 21 is advanced, i.e., the lean responsiveness of the oxygen sensor 21 is increased. Portions of the ECU 25 (or the microcomputer 26) which perform control operations of steps 205 and 206 may be used as an example of the characteristic control portion.

In the above-described fourth embodiment, when the lean correction is performed in the sub feedback control, the constant current Ics is corrected so that the timing of the lean detection of the oxygen sensor 21 becomes earlier than that in the case where the value of the constant current Ics is equal to the reference current value Io. When the rich correction is performed in the sub feedback control, the constant current Ics is corrected so that the timing of the rich detection of the oxygen sensor 21 becomes earlier than that in the case where the value of the constant current Ics is equal to the reference current value Io. Thus, even in the system in which the value of the constant current Ics is generally set equal to the reference current value Io determined based on an engine operating condition during an operation of the engine 11, the value of the constant current Ics can be set with reference to the reference current value Io in the sub feedback control so that the rich responsiveness or the lean responsiveness of the oxygen sensor 21 is increased. Accordingly, effects similar to the first embodiment can be obtained in the fourth embodiment.

The technology of the second embodiment may be combined with the technology of the fourth embodiment. Specifically, when the lean correction is performed in the sub feedback control, the target voltage of the output of the oxygen sensor 21 may be set lower than the reference voltage. When the rich correction is performed in the sub feedback control, the target voltage of the output of the oxygen sensor 21 may be set higher than the reference voltage.

The technology of the third embodiment may be combined with the technology of the fourth embodiment. Specifically, a value of the constant current Ics may be set depending on the difference between the output of the oxygen sensor 21 and the target voltage. For example, the predetermined value ΔI may be set depending on the difference between the output of the oxygen sensor 21 and the target voltage. Furthermore, the technologies of the second and third embodiments may be combined with the technology of the fourth embodiment.

Although the present disclosure has been fully described in connection with the preferred embodiments thereof with reference to the accompanying drawings, it is to be noted that various changes and modifications will become apparent to those skilled in the art. In the above-described first to fourth embodiments, the constant current circuit 27 is connected to the atmosphere electrode layer 34 of the oxygen sensor 21 (sensor element 31). However, for example, the constant current circuit 27 may be connected to the exhaust electrode layer 33 of the oxygen sensor 21 (sensor element 31), or the constant current circuit 27 may be connected to both the atmosphere electrode layer 34 and the exhaust electrode layer 33.

In the above-described first to fourth embodiments, the present disclosure is applied to the emission control system 1 including the oxygen sensor 21 that has the cup-like shaped sensor element 31. However, for example, the present disclosure may be applied to an emission control system including an oxygen sensor that has a sensor element having a laminated structure.

In the above-described first to fourth embodiments, the present disclosure is applied to the emission control system 1 in which the oxygen sensor 21 is located downstream of the upstream catalyst 18 in the flow direction of the exhaust gas. However, the present disclosure is not limited to the upstream catalyst 18 or the oxygen sensor 21. The present disclosure may be applied to an emission control system in which an exhaust gas sensor, such as an oxygen sensor or an air-fuel ratio sensor, is located downstream of a catalyst for purification of exhaust gas in a flow direction of the exhaust gas.

Additional advantages and modifications will readily occur to those skilled in the art. The disclosure in its broader terms is therefore not limited to the specific details, representative apparatus, and illustrative examples shown and described.

What is claimed is:

1. An emission control system for an internal combustion engine, a catalyst used for purification of exhaust gas discharged from the engine;

an upstream exhaust-gas sensor provided upstream of the catalyst in a flow direction of the exhaust gas to detect an upstream air-fuel ratio of the exhaust gas flowing upstream of the catalyst or to detect whether the exhaust gas is rich or lean;

a main feedback control portion which corrects a fuel injection amount of the engine based on an output value of the upstream exhaust-gas sensor in a main feedback control so that the upstream air-fuel ratio becomes equal to an upstream target air-fuel ratio;

a downstream exhaust-gas sensor provided downstream of the catalyst in the flow direction of the exhaust gas to detect a downstream air-fuel ratio of the exhaust gas flowing downstream of the catalyst or to detect whether the exhaust gas is rich or lean, wherein the downstream exhaust-gas sensor includes a sensor element that includes a pair of electrodes and a solid electrolyte body located between the pair of electrodes;

a sub feedback control portion which corrects the upstream target air-fuel ratio or the fuel injection amount based on an output value of the downstream exhaust-gas sensor in a sub feedback control so that the downstream air-fuel ratio becomes equal to a downstream target air-fuel ratio;

a constant current supply portion which changes an output characteristic of the downstream exhaust-gas sensor by applying a constant current on the pair of electrodes and setting a flow direction of the constant current between the pair of electrodes; and a characteristic control portion which controls the constant current supply portion, wherein the characteristic control portion controls the constant current supply portion to apply the constant current on the pair of electrodes so as to advance a timing of a lean detection of the downstream exhaust-gas sensor, when the downstream air-fuel ratio is richer than the downstream target air-fuel ratio, and when the sub feedback control portion corrects the downstream air-fuel ratio such that the downstream air-fuel ratio becomes leaner in the sub feedback control, and the characteristic control portion controls the constant current supply portion to apply the constant current on the pair of electrodes so as to advance a timing of a rich detection the downstream exhaust-gas sensor, when the downstream air-fuel ratio is leaner than the downstream target air-fuel ratio, and when the sub feedback control portion corrects the downstream air-fuel ratio such that the downstream air-fuel ratio becomes richer in the sub feedback control.

2. The emission control system according to claim 1, wherein the characteristic control portion corrects a value of the constant current so that the timing of the lean detection of the downstream exhaust-gas sensor becomes earlier than that of a case where the value of the constant current is equal to a reference current value that is dependent on an operating condition of the engine, when the sub feedback control portion corrects the downstream air-fuel ratio such that the downstream air-fuel ratio becomes leaner in the sub feedback control, and the characteristic control portion corrects a value of the constant current so that the timing of the rich detection of the downstream exhaust-gas sensor becomes earlier than that of a case where the value of the constant current is equal to a reference current value, when the sub feedback control portion corrects the downstream air-fuel ratio such that the downstream air-fuel ratio becomes richer in the sub feedback control.

3. The emission control system according to claim 1, wherein the characteristic control portion sets the downstream target air-fuel ratio leaner than a reference air-fuel ratio when the sub feedback control portion corrects the downstream air-fuel ratio such that the downstream air-fuel ratio becomes leaner in the sub feedback control, and the characteristic control portion sets the downstream target air-fuel ratio richer than the reference air-fuel ratio when the sub feedback control portion corrects the downstream air-fuel ratio such that the downstream air-fuel ratio becomes richer in the sub feedback control.

4. The emission control system according to claim 1, wherein the characteristic control portion sets a value of the constant current depending on a difference between the output value of the downstream exhaust-gas sensor and the downstream target air-fuel ratio.

* * * * *